United States Patent [19]

Wood

[11] Patent Number: 4,793,400

[45] Date of Patent: Dec. 27, 1988

[54] DOUBLE BRUSHING OF GROOVED CASTING WHEELS

[75] Inventor: Richard A. Wood, Columbus, Ohio

[73] Assignee: Battelle Development Corporation, Columbus, Ohio

[21] Appl. No.: 124,746

[22] Filed: Nov. 24, 1987

[51] Int. Cl.[4] ..... B22D 11/06

[52] U.S. Cl. ..... 164/121; 164/158; 164/423; 164/463; 164/429

[58] Field of Search ..... 164/121, 158, 463, 479, 164/423, 427, 429

[56] References Cited

U.S. PATENT DOCUMENTS 2,348,178 5/1944 Merle .
4,588,015 5/1986 Liebermann ..... 164/463
4,708,194 11/1987 Mohn ..... 164/158

FOREIGN PATENT DOCUMENTS 59-229263 12/1984 Japan ..... 164/463
87/02284 4/1987 PCT Int'l Appl. .

*Primary Examiner*—Nicholas P. Godici
*Assistant Examiner*—Richard K. Seidel
*Attorney, Agent, or Firm*—Sidney W. Millard

[57] ABSTRACT

In combination with a rotating casting drum and a tundish for feeding molten metal to the surface of said drum, a pair of rotating brushes in tandem which rotate in the opposite direction to the drum rotation to clean the casting surface prior to the deposit of molten metal from the tundish.

38 Claims, 2 Drawing Sheets

DOUBLE BRUSHING OF GROOVED CASTING WHEELS

FIELD OF THE INVENTION

This invention relates to a melt drag process and apparatus for continuous casing of metal on a rotating casting surface and the particular technique and apparatus for cleaning the casting surface.

BACKGROUND OF THE INVENTION

The casting of thin metal filaments developed from a metal extraction process includes a container of molten metal and a rotating disk with a sharp pointed periphery which is lowered into the melt. As the periphery of the disk passes through the molten metal a certain portion of the metal adheres to the cooler metal disk to form a filament or wire. When the disk emerges from the molten material the mass adhered to the disk periphery freezes and as a result contracts in volume, thereby squeezing itself off of the periphery of the disk and separating as a wire product.

Later development involved feeding the rotating disk by gravity from a tundish supported above the horizontal axis of the casting surface.

Relatively recently techniques have been developed for casting thin but wide strips of metal by this technique using a rotating casting surface in the form of a drum or cylinder. The main problem has been defects in the cast strip. Unfortunately the defects create a non-uniform product because the kinds of defects are not predictably located. Various theories have been advanced as to why there is no uniformity in the cast strip but it is believed to be generally accepted that much of the problem stems from differential cooling rates in the solidifying metal.

A partial solution to that particular problem has been suggested and is generally accepted, namely, providing circumferential grooves around the cylindrical casting surface. It is important that the grooves be relatively shallow and numerous, for example, the depth recommended is about 0.025–0.25 millimeters. It is also recommended that there by from eight to thirty-five grooves per centimeter across the surface of the casting drum. This is described in International Patent Publication No. WO87/02284 and to the extent necessary for an understanding of this invention said publication is incorporated herein by reference.

It will be noted in said International Patent Publication that it is desirable to condition the surface of the rotating casting drum at a location between the place where the cast strip separates from the casting surface and where the casting surface again encounters the molten metal discharged by the tundish. The publication suggests wiping the casting surface with cloth or a horsehair brush.

Unfortunately, the use of such surface conditioning apparatus is inadequate because a certain portion of the molten metal will have adhered to the casting surface and dust and debris from the factory environment and the flakes of metal not separating from the casting surface tend to create heat transfer differentials in the metal strip drawn from the melt.

There is a need for greater efficiency in removing dust, debris and melt residue from the casting surface prior to the time it re-enters the melt.

SUMMARY OF THE INVENTION

This invention solves this problem, to a certain extent, by providing two conditioning brushes in tandem adjacent the rotating casting surface. To a great extent, what debris not removed by the first brush in the sequence and the debris removed but re-deposited on the casting surface is in turn removed more completely by the second brush in the sequence. An additional optional structure includes a vacuum duct adjacent each brush to collect the debris removed from the casting surface by the brush.

The combination which embodies this invention includes a tundish mounted adjacent a rotating drum having a peripheral casting surface. The casting surface has a plurality of circumferentially extending grooves to provide a more uniform heat transfer from the molten metal to the casting surface.

Between the place where the solidified metal separates from the rotating casting surface as a thin metal sheet and the place where the casting surface re-enters the melt in the continuous process, there is provided a pair of rotating brushes in tandem which serve to effectively clean and condition the casting surface on a continuous basis just prior to the time the casting surface re-enters the melt supplied by the tundish.

Adjusting apparatus is provided to allow the pressure exerted by the rotating brushes to be controlled. For example it was found that the first brush in the sequence should be pressed against the rotating casting surface with greater force than the second brush in the tandem series.

Objects of the invention, not clear from the above, will be understood more fully by a review of the drawings and the description of the preferred embodiment which follows.

DESCRIPTION OF THE PREFERRED EMBODIMENT

Figure 1:
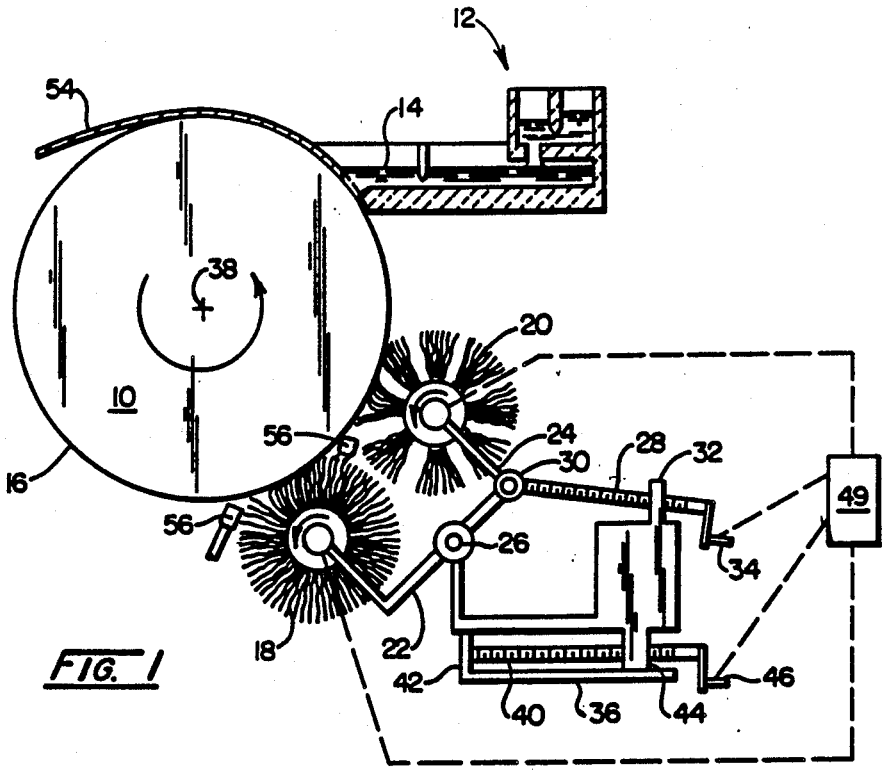
FIG. 1 is a schematic elevational view of the combination of a casting drum, a tundish feeding molten metal onto the drum periphery and a cleaning and conditioning set of brushes for the casting surface.
Figure 2:
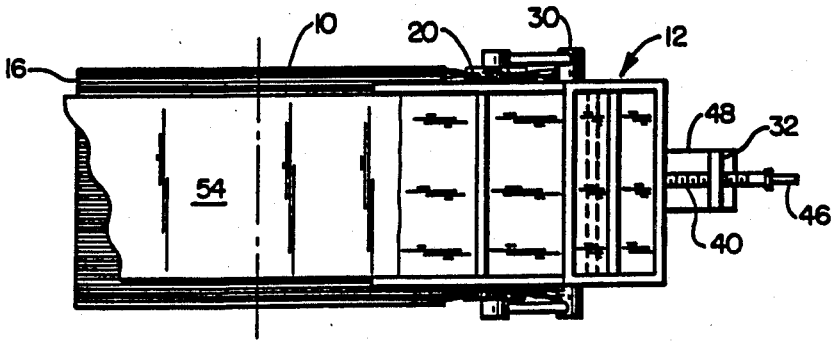
FIG. 2 is a top plan view of the FIG. 1.

FIG. 1 illustrates in somewhat schematic form a rotating casting drum 10 mounted adjacent a tundish 12 which feeds molten metal 14 to the casting surface 16 of the rotating drum. Note that the metal is fed by gravity and the feed is above the horizontal centerline of the drum at an angle of about 45°.

Below the tundish 12 and contacting casting surface 16 are a pair of brushes 18 and 20 in tandem. The first brush 18 in the sequence is mounted on a support arm 22, the second brush 20 is mounted on another support arm 24 and both arms are pivotable about pivot point 26. A shown, arms 22 and 24 are rigidly connected together and the movement of one arm about pivot point 26 will also move the other arm through the same angle.

It is preferred that the brushes be located near to the liquid metal feed so that the cleaning-conditioning of the casting surface will have a minimum amount of time in the industrial environment prior to receiving the molten metal. Accordingly the brushes are located below the tundish 12 but as close as possible without interference.

A threaded rod 28 is connected to arm 24 at a connecting joint 30. Rod 28 is mounted in threaded engagement with a projection of 32 and a rotation of the rod by handle 34 serves to pivot arms 22 and 24 about pivot point 26 to allow adjustment of pressures exerted against casting surface 16 by brushes 18 and 20.

The brush adjusting apparatus is all mounted on a substrate 36 which is stationary with respect to the horizontal axis 38 of casting drum 10.

A second threaded rod 40 has one end abutting and connected to a shoulder 42, said shoulder 42 projecting upwardly from substrate 36 as shown in the drawing. The threads of rod 40 threadedly engage downwardly extending projection 44. Thereby, a rotation of rod 40 by handle 46 moves brush support block 48 either left or right as viewed in FIG. 1. Rotation of handle 46 moves the brushes 18 and 20 into contact or out of contact with casting surface 16 and rotation of handle 34 adjusts the angle of the brushes in their contact with surface 16. Handles 34 and 46 may be supplanted by reversible drive motors, monitoring field amperages for pressure control, for remote operation all indicated generally as control box 49.

Figure 3:
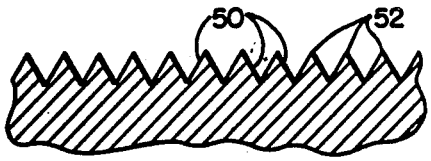
FIG. 3 is a fragmentary sectional view of the casting surface of the drum of FIG. 1 showing a pattern of grooves in the surface.
Figure 4:
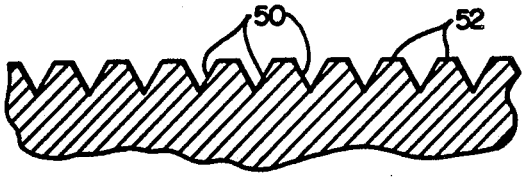
FIG. 4 is an alternative embodiment of FIG. 3.
Figure 5:
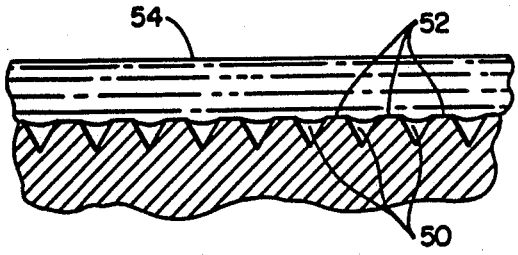
FIG. 5 is an alternative embodiment to FIG. 3 and showing the cast metal strip engaging the crests of the ridges separating the grooves in the casting surface.

Looking now to FIGS. 3 through 5, each illustrates a fragmentary sectional view of the surface 16. It includes a plurality of circumferentially extending grooves 50 and intermediate the grooves are lands 52. In FIG. 3 the "lands" are very, very small having a width approaching zero, but as a general rule the width of the lands should be about 0.025–1.00 millimeters and the depth of the grooves should be about 0.025–0.25 millimeters. Preferably the included angle of the sides of the grooves between each land is about 30°–60° and there are about eight to thirty-five grooves per centimeter across the surface 16.

The illustration in FIG. 5 includes a thin layer of solidified metal in the form of a sheet 54. The apparent curved dip of the molten metal into the grooves 50 is exaggerated for purposes of illustration. The closeness of the grooves may prevent the molten metal from migrating to the bottom of the grooves by virtue of the surface tension of the molten metal. Experiments have indicated nucleation at land edges and most frequently there is nucleation across the entire land surface.

The molten metal itself may be aluminum alloy, copper alloy, steel, or other material and the casting drum is formed of, for example, but not necessarily limited to copper, copper-chromium, steel, and aluminum alloy.

In operation, before molten metal 14 is delivered to the tundish 12, the drum 10 is rotated and brushes 18 and 20 are adjusted. First a rough adjustment is made of the brushes by a rotation of handle 34, then while drum 10 is rotating about horizontal axis 38 handle 46 is rotated to advance the brushes into engagement with surface 16. The first brush 18 will be adjusted to have a light pressure exerted and brush 20 will be adjusted to have an even lighter pressure. The force or pressure of the brushes is measured by a meter connected to the power source to the motors driving said brushes (not shown). By measuring the amperage drawn down by the electric motors the relative pressures between the individual brushes and the casting surface may be determined. After a satisfactory pressure relationship is established handle 46 will again be turned to withdraw the brushes from contact with surface 16 and molten metal is being discharged from surface 16 as sheet 54, handle 46 will again be turned to advance the brushes into engagement with the casting surface 16. Alternatively, as indicated above, the whole process may be performed manually or through a control box 49.

Note that the brushes have bristles which bend in their engagement of surface 16 at a point in a plane extending between the axes of the drum 10 and the brushes 18 and 20. It has been found to be very effective to have the bristles bent over at an angle because when they straighten as they pass the center point of their deflection they tend to flick debris out of the grooves of the casting surface. This has been found to be much more effective then merely the "kiss" contact recommended by most brush manufacturers. The degree of bend is significant. It has been discovered that better surface cleaning results where the bristles are bent to the extent that the side of the bristle engages the bottom of the groove 50. It is believed that the reason for the better cleaning is the sweeping-flicking action of each bristle as it rebounds to its straight condition. The "kiss" contact recommended by brush manufactures is where only the tip of each bristle would reach to the bottom of the groove and then only when all bristles are of uniform length. In reality all bristles are not of uniform length and as a consequence the "kiss" contact technique provides a non-uniform result. The bent bristle concept insures that all groove areas will be swept clean and a more uniform surface conditioning is the result.

In some instances it may be desirable to have a vacuum duct 56 adjacent each brush to collect the dust and debris stripped from the casting surface as it is flung from the brush. In other instances it may be desirable to place a "beater bar" (not shown) such that it is struck by the brush and thereby causes debris adhering to the brush to be thrown free.

The force with which the brushes are engaging surface 16 is important. If the pressure is too great it will tend to erode and excessively wear the casting surface and unfortunately, when the casting surface wears it tends to create burrs. Burrs on the casting surface tend to prevent the separation of the solidified sheet 54 from the drum. Excessively aggressive brushing removes the metal oxide which naturally forms on the surface of the casting surface 16 but more moderate pressure allows the oxide layer to remain and easier sheet separation and lower wear are the result.

As might be anticipated, due to the light pressure desirable in this invention the size, length and composition of the bristles of the brushes are important. The bristles themselves should be about 0.005–0.030 inches in diameter and from 1.5–3.0 inches in length and are preferably of materials such as, but not limited to, brass, horsehair or silicon carbide impregnated nylon. Both brushes could have the same bristle material but it is preferred that the first brush 18 be more aggressive, e.g. having bristles of brass, and the second brush 20 be less aggressive, e.g. having bristles of silicon carbide impregnated nylon.

FIG. 1 shows two different kinds of brushes. Brush 18 is a full brush with uniformly distributed bristles throughout the brushing area. On the other hand brush 20 is a series of parallel rows of bristles and the rows are spaced apart so that the brushing periphery is not uniform.

The non-uniform brush 20 of spaced apart rows is the preferred embodiment for both brushes. The reason is the flick or flip of the straightening bristles as they pass beyond the center point of the plane between the axes of the drum and the brush. The full bristled brush 18 inhibits the full over-center rebound of the bristles due to the dense configuration whereas the spacing between rows of bristles as shown in brush 20 allows the full rebound swing of the bristles.

It is preferred that the casting surface be rotating with a lineal speed of about one hundred to one thousand centimeters per second. Under that limitation it is preferred that brushes 18 and 20 be about ten inches in diameter and be rotating in the same direction as the drum at about four hundred to seven hundred rotations per minute. Thus, because they rotate in the same direction, their contact surfaces are moving in opposite directions and the relative speeds are seen by a flake of metal in one of the grooves will be a bristle approaching at about 1650 to 3800 cm/sec. The modulus of elasticity of the bristles, the pressure between the casting surface and the brushes, and the speed of impact combine to provide optimum system operation. Two conditioning brushes in tandem enhance the conditioning process.

Having thus described the invention in its preferred embodiment it will be clear that modifications may be made to the structure and procedural sequence without departing from the spirit of the invention. Accordingly, it is not intended that the drawings illustrating the invention nor the words used to describe the same be limiting on the invention. Rather it is intended that the invention be limited only by the scope of the appended claims.

I claim:

1. A process for conditioning a casting surface comprising, providing a cylindrical casting surface mounted to rotate about its axis, orienting said axis to the horizontal position, rotating said surface about said axis and positioning said surface adjacent a tundish to receive molten metal on said surface from said tundish, said tundish being located above a horizontal plane which includes said axis, providing grooves in said casting surface, said grooves extending generally in the direction of the rotation of said surface, cleaning the casting surface by contacting said surface with two bristled brushes, said brushes being in tandem and mounted to rotate about their axes, the direction of rotation of both brushes being the same direction of rotation as said casting surface, thereby the contact areas between the brushes and the casting surface are moving in opposite directions, changing the contact pressure between the brushes and the casting surface while the casting surface is rotating, adjusting the contact pressure between each brush and the casting surface to a degree that the bristles of each rotating brush in contact with the rotating casting surface are bent in the direction of rotation of said casting surface, the degree of contact and bend being such that the sides of the bristles on each brush are in contact with the casting surface in a plane passing through the axes of the casting surface and the brush.

2. The process of claim 1 including starting the rotation of the casting surface prior to moving the brushes into contact with said surface.

3. The process of claim 2 wherein some of the bristles comprise nylon impregnated with silicon carbide.

4. The process of claim 3 wherein some of the bristles are brass.

5. The process of claim 4 including mounting the brushes in tandem with the first brush contacting the rotating casting surface includes brass bristles and the second brush includes nylon impregnated silicon carbide bristles.

6. The process of claim 5 including pressing said second brush against the casting surface with less force than the force pressing the first brush against the casting surface.

7. The process of claim 6 wherein the bristles of the first brush are uniformly mounted to define a brush of generally cylindrical profile in cross-section.

8. The process of claim 7 wherein the bristles of the second brush are mounted in spaced apart rows.

9. The process of claim 1 wherein some of the bristles comprise nylon impregnated with silicon carbide.

10. The process of claim 1 wherein some of the bristles are brass.

11. The process of claim 1 including mounting the brushes in tandem with the first brush contacting the rotating casting surface includes brass bristles and the second brush includes nylon impregnated silicon carbide bristles.

12. The process of claim 11 including pressing said second brush against the casting surface with less force than the force pressing the first brush against the casting surface.

13. The process of claim 12 wherein the bristles of the first brush are uniformly mounted to define a brush of generally cylindrical profile in cross-section.

14. The process of claim 13 wherein the bristles of the second brush are mounted in spaced apart rows.

15. The process of claim 1 wherein the bristles of the first brush are uniformly mounted to define a brush of generally cylindrical profile in cross-section.

16. The process of claim 1 wherein the bristles of the second brush are mounted in spaced apart rows.

17. The process of claim 1 including pressing said second brush against the casting surface with less force than the force pressing the first brush against the casting surface.

18. The process of claim 17 wherein the bristles of the first brush are uniformly mounted to define a brush of generally cylindrical profile in cross-section.

19. The process of claim 18 wherein the bristles of the second brush are mounted in spaced apart rows.

20. Apparatus for conditioning a casting surface including in combination a cylindrical casting surface mounted adjacent a tundish to receive molten metal from said tundish while said casting surface rotates, a plurality of circumferentially extending grooves in the casting surface and two rotatable brushes for cleaning the casting surface, said casting surface having a horizontal axis about which it rotates, each said brush being rotatable about an axis and each brush axis being parallel to said casting surface axis, said brushes being mounted in tandem to contact the casting surface in sequence during its rotation, each brush being rotatable in the same direction as the rotation of the casting surface, means for moving said brushes into contact with the casting surface whereby when said brushes and said casting surface are rotating their contacting areas are moving in opposition directions, means for adjusting the degree of pressure of each brush at said contact area while the casting surface is rotating.

21. The apparatus of claim 20 wherein the bristles of at least one of said brushes is comprised of nylon impregnated with silicon carbide.

22. The apparatus of claim 21 wherein at least some of the bristles are comprised of brass.

23. The apparatus of claim 21 wherein one of the brushes includes bristles of brass and the other includes bristles of nylon impregnated with silicon carbide.

24. The apparatus of claim 23 wherein the bristles of the brass brush are uniformly mounted to define a brush of generally cylindrical profile in cross section.

25. The apparatus of claim 24 wherein the bristles of the nylon impregnated with silicon carbide brush are mounted in spaced apart rows.

26. The apparatus of claim 20 wherein at least some of the bristles are comprised of brass.

27. The apparatus of claim 20 wherein the brush nearest the tundish is in contact with the casting surface at a pressure lower than the contact pressure between the casting surface and the other brush.

28. The apparatus of claim 20 including vacuum means for removing debris from the area of the casting surface as removed by the rotating brushes.

29. A process for conditioning a casting surface comprising, providing a cylindrical casting surface mounted to rotate about its axis, orienting said axis to the horizontal position, rotating said surface about said axis and positioning said surface adjacent a tundish to receive molten metal on said surface from said tundish, said tundish being located above a horizontal plane which includes said axis, providing grooves in said casting surface, said grooves extending generally in the direction of the rotation of said surface, cleaning the casting surface by contacting said surface with two bristled brushes, said brushes being in tandem and mounted to rotate about their axes, the direction of rotation of both brushes being the same direction of rotation as said casting surface, thereby the contact areas between the brushes and the casting surface are moving in opposite directions, one of said brushes including bristles of brass and the other of said brushes including bristles of nylon impregnated with silicon carbide, adjusting the contact pressure between each brush and the casting surface to a degree that the bristles of each rotating brush in contact with the rotating casting surface are bent in the direction of rotation of said casting surface, the degree of contact and bend being such that the sides of the bristles on each brush are in contact with the casting surface in a plane passing through the axes of the casting surface and the brush.

30. The process of claim 29 including starting the rotation of the casting surface prior to moving the brushes into contact with said surface.

31. The process of claim 30 including mounting the brushes in tandem with the first brush contacting the rotating casting surface includes brass bristles and the second brush includes nylon impregnated silicon carbide bristles.

32. The process of claim 31 including pressing said second brush against the casting surface with less force than the force pressing the first brush against the casting surface.

33. The process of claim 32 wherein the bristles of the first brush are uniformly mounted to define a brush of generally cylindrical profile in cross-section.

34. The process of claim 33 wherein the bristles of the second brush are mounted in spaced apart rows.

35. The process of claim 29 including mounting the brushes in tandem with the first brush contacting the rotating casting surface includes brass bristles and the second brush includes nylon impregnated silicon carbide bristles.

36. The process of claim 29 wherein the bristles of the first brush are uniformly mounted to define a brush of generally cylindrical profile in cross-section.

37. The process of claim 29 wherein the bristles of the second brush are mounted in spaced apart rows.

38. The process of claim 29 including pressing said second brush against the casting surface with less force than the force pressing the first brush against the casting surface.

* * * * *

UNITED STATES PATENT AND TRADEMARK OFFICE

Certificate

Patent No. 4,793,400 Patented: December 27, 1988

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is:
Richard A. Wood, Ray D. Wood and John P. Ingalls.

Signed and Sealed This 19th Day of December 1989.

NICHOLAS P. GODICI

*Supervisory Patent Examiner*
*Art Unit 325*